US009103587B2

(12) United States Patent
Ha et al.

(10) Patent No.: US 9,103,587 B2
(45) Date of Patent: Aug. 11, 2015

(54) PROCESS AND APPARATUS FOR THE SEPARATION OF AIR BY CRYOGENIC DISTILLATION

(75) Inventors: Bao Ha, San Ramon, CA (US); Jean-Renaud Brugerolle, Neuchatel (CH)

(73) Assignee: L'Air Liquide Société Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 1043 days.

(21) Appl. No.: 12/640,167

(22) Filed: Dec. 17, 2009

(65) Prior Publication Data

US 2011/0146343 A1 Jun. 23, 2011

(51) Int. Cl.
*F25J 3/00* (2006.01)
*F25J 3/04* (2006.01)

(52) U.S. Cl.
CPC ..... *F25J 3/04836* (2013.01); *F25J 3/0409* (2013.01); *F25J 3/0429* (2013.01);
(Continued)

(58) Field of Classification Search
CPC ..... F25J 3/04054; F25J 3/0409; F25J 3/0429; F25J 3/04303; F25J 3/0475; F25J 3/04393; F25J 3/04454; F25J 3/04812; F25J 3/04824; F25J 3/04836; F25J 3/04872; F25J 3/04884; F25J 3/04951; F25J 2200/08; F25J 2200/10; F25J 2205/30; F25J 2210/06; F25J 2245/42; F25J 2290/12; F25J 2290/40; F25J 2290/802
USPC ..... 62/646, 647, 643
See application file for complete search history.

(56) References Cited

U.S. PATENT DOCUMENTS 5,341,646 A * 8/1994 Agrawal et al. ..... 62/646
5,918,482 A * 7/1999 Potempa ..... 62/646
(Continued)

FOREIGN PATENT DOCUMENTS

EP 1030148 8/2000
EP 1318367 6/2003

OTHER PUBLICATIONS

Anonymous, "Nitrogen Generous Process,", Research Disclosure, Mason Publications, Hampshire, GB, vol. 464, No. 96, Dec. 1, 2002 (5 pp).
PCT/US2010/058887, International Search Report and Written Opinion, Jan. 30, 2014 (11 pp).
PCT/US2010/058887, International Preliminary Report on Patentability, Feb. 18, 2014 (7 pp).

*Primary Examiner* — Frantz Jules
*Assistant Examiner* — Keith Raymond
(74) *Attorney, Agent, or Firm* — Justin K. Murray

(57) ABSTRACT

A process for the cryogenic separation of air using a multiple column distillation system comprising at least a higher pressure column ("HP column") and a lower pressure column ("LP column"), comprising: feeding cooled feed air to the high pressure column for separation into high pressure nitrogen-enriched overhead vapor and crude liquid oxygen; feeding at least one low pressure column feed stream comprising nitrogen and oxygen to the low pressure column for separation into nitrogen-rich overhead vapor and liquid oxygen; refluxing the low pressure column with a liquid stream from or derived from the high pressure column; feeding expanded air to an auxiliary separation column for separation into auxiliary column nitrogen-rich overhead vapor and oxygen-rich liquid and removing the nitrogen rich overhead vapor as a product stream; feeding bottom liquid from the auxiliary column to an intermediate location of the low pressure column; and refluxing the auxiliary column with a nitrogen rich liquid stream from or derived from the HP column.

12 Claims, 2 Drawing Sheets

(52) U.S. Cl.
CPC ..... *F25J 3/0443* (2013.01); *F25J 3/04054* (2013.01); *F25J 3/04254* (2013.01); *F25J 3/04303* (2013.01); *F25J 3/04393* (2013.01); *F25J 3/04454* (2013.01); *F25J 3/04793* (2013.01); *F25J 3/04812* (2013.01); *F25J 3/04824* (2013.01); *F25J 3/04872* (2013.01); *F25J 3/04951* (2013.01); *F25J 2200/10* (2013.01); *F25J 2200/32* (2013.01); *F25J 2205/30* (2013.01); *F25J 2210/06* (2013.01); *F25J 2210/40* (2013.01); *F25J 2245/42* (2013.01); *F25J 2290/12* (2013.01); *F25J 2290/80* (2013.01)

(56) References Cited

U.S. PATENT DOCUMENTS

| | | | | |
|---|---|---|---|---|
| 6,116,052 | A | 9/2000 | Ha et al. | |
| 6,227,005 | B1 * | 5/2001 | Higginbotham et al. | 62/646 |
| 6,397,631 | B1 | 6/2002 | Griffiths et al. | |
| 2009/0120129 | A1 * | 5/2009 | Howard | 62/651 |
| 2010/0242538 | A1 * | 9/2010 | Prosser et al. | 62/646 |
| 2011/0138855 | A1 * | 6/2011 | Howard et al. | 62/644 |

* cited by examiner

PROCESS AND APPARATUS FOR THE SEPARATION OF AIR BY CRYOGENIC DISTILLATION

The present invention relates to a process and an apparatus for the separation of air by cryogenic distillation.

BACKGROUND OF THE INVENTION

Very large gas or coal gasification sites may be built in the near future. All gasification processes require large quantities of high pressure oxygen.

Air separation unit (ASU) plant sizes have been growing steadily over the last four decades and there is no sign for the trend to stop. With plant sizes getting larger and larger, liquid back-up issues become impractical or impossible for plant outages lasting for more than a few hours.

Current technologies would allow plant sizes up to 7000 metric tonnes of oxygen per day. Presently, largest reference plant sizes are between 4000 and 5000 metric tonnes per day.

Coal gasification in the near future for example may require very large oxygen consumption reaching as high as 50 000 T/D. Gas-to-liquid GTL plant is another example with high oxygen requirement in the range of 20 000-40 000 T/D. It becomes obvious there is a need for an improved and rational production concept for oxygen in such large facilities.

This invention provides a new approach for building large facilities requiring multiple large trains of oxygen plants. A new concept for cost effective production back-up is also integrated in this new scheme.

DETAILED DESCRIPTION OF THE INVENTION

Figure 1:
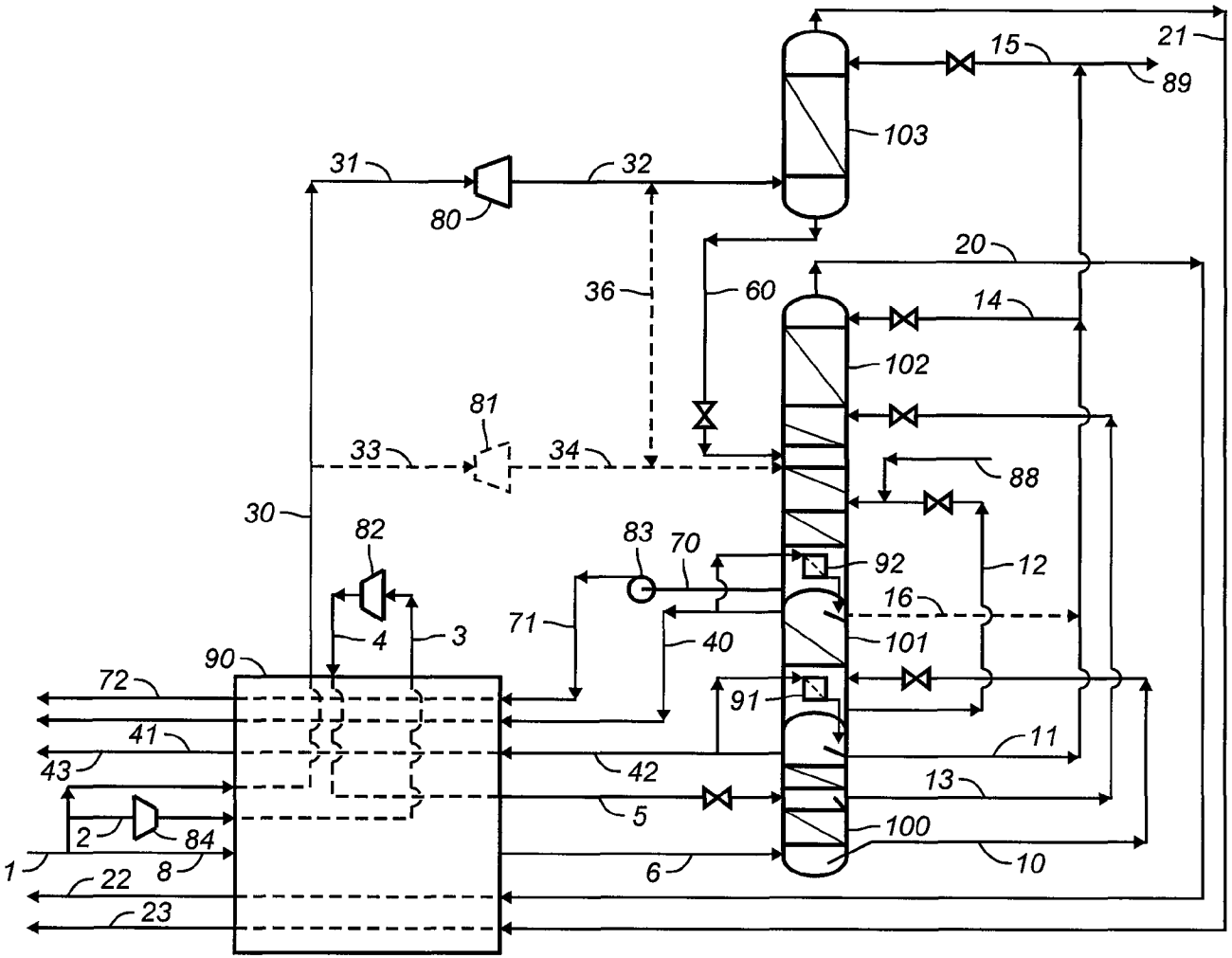
FIG. 1 illustrates a modified triple column process in accordance for one embodiment of the proposed large oxygen plant.

This invention covers three main aspects for the cryogenic process for large air separation facilities:

1. The choice of the process of the oxygen plant: the objective of this invention is to provide an air separation process capable of very high oxygen production. Another feature of the selected process is its ability to efficiently accommodate higher air flow to increase the oxygen production.
2. The economical backup for multiple trains: the purpose of this aspect of the invention is to provide a new approach for backing up plant production by increasing air flow or boosting.

In order to reach a very high production throughput a different process scheme for air separation plant is needed. The traditional double column process operates at low feed air pressure about 6 bar requiring large adsorption vessels for front end clean up to remove moisture and $CO_2$ prior to the cryogenic portion of the oxygen plant.

In most situations, the nitrogen flow at the top of the column dictates the column size, or the plant size. The bottleneck occurs not only at the top of the low pressure column but also at the top of the high pressure column. Therefore, in order to significantly increase the production output, the selected process must reduce the vapor flow at the top of all columns.

The top flow of the high pressure column can be reduced by generating the plant refrigeration by expanding some feed air into the low pressure column. The expanded air flow must be limited otherwise the distillation efficiency would be reduced, since the expanded air flow decreases the reboil and reflux of the low pressure column.

The top flow of the low pressure column can be minimized by extracting nitrogen from the top of the high pressure column such that less nitrogen will reach the low pressure column hence reducing the low pressure column's top vapor flow. Again, the extracted nitrogen flow must be limited because of the distillation efficiency consideration.

The double column scheme is not very well adapted when it comes to maximizing the expanded air flow or the high pressure nitrogen extraction. Indeed, for oxygen purities of about 95-97% mol, approximately 25-30% of the total feed air can be expanded to the low pressure column. With this much expanded air, it becomes difficult to efficiently extract nitrogen from the high pressure column. It is clear that the air expansion can reduce the top vapor flow of the high pressure column but does not reduce the top flow of the low pressure column since the nitrogen contained in the expanded air must exit at the top of the low pressure column. Without the expanded air, as high as 20-25% of the total air flow can be removed as nitrogen at the top of the high pressure column. Since the oxygen flow represents 20% of the feed air, this means a flow representing about 55-60% of the total air feed flow must exit at the top of the low pressure column. If more nitrogen is removed from the high pressure column, the distillation efficiency will suffer resulting in loss of oxygen recovery and higher air flow is needed to produce the given amount of oxygen. Therefore this technique of nitrogen removal can improve the top flow of the low pressure column but has no effect on the top flow of the high pressure column.

According to the present invention, there is provided a process for the cryogenic separation of air using a multiple column distillation system comprising at least a higher pressure column ("HP column") and a lower pressure column ("LP column"), said process comprising: feeding cooled feed air to the high pressure column for separation into high pressure nitrogen-enriched overhead vapor and crude liquid oxygen; feeding at least one low pressure column feed stream comprising nitrogen and oxygen to the low pressure column for separation into nitrogen-rich overhead vapor and liquid oxygen; refluxing the low pressure column with a liquid stream from or derived from the high pressure column; feeding expanded air to an auxiliary separation column for separation into auxiliary column nitrogen-rich overhead vapor and oxygen-rich liquid and removing the nitrogen rich overhead vapour as a product stream; feeding bottom liquid from the auxiliary column to an intermediate location of the low pressure column; and refluxing the auxiliary column with a nitrogen rich liquid stream from or derived from the HP column.

According to optional features;

- the vapor flow rate in the auxiliary column is determined such that the diameters of the upper sections of the low pressure column are not larger than that for any other section of the multiple distillation column system.
- the vapor flow rate in the auxiliary separation column is greater than about 50 percent of the vapor flow rate in the upper LP column sections.
- none of the liquid oxygen from the low pressure column is sent to a mixing column.

the process comprises an intermediate pressure column which receives crude liquid oxygen from the high pressure column and produces the at least one low pressure column feed stream comprising nitrogen and oxygen which feeds the low pressure column.

the liquid oxygen is withdrawn from the low pressure column and vaporised in a main heat exchanger.

the amount of liquid oxygen withdrawn from the low pressure column increases, the amount of expanded air sent to the auxiliary column increases by x %, the amount of gaseous air sent to the high pressure column increases by y %, y being less than x and the operating pressure of the auxiliary column increases.

y is substantially zero.

air is expanded into the low pressure column and if the amount of liquid oxygen withdrawn increases the amount of air expanded to the low pressure column increases by z %, z being less than x.

the process comprises removing high pressure nitrogen-enriched overhead vapor from the top of the high pressure column; condensing at least a portion thereof in a reboiler/condenser located in the bottom of the low pressure column; and feeding at least a portion of the condensed nitrogen as reflux to the HP column.

the auxiliary column is refluxed with condensed nitrogen produced in the reboiler/condenser.

liquid in the auxiliary separation column is not boiled by a reboiler/condenser.

According to a further aspect of the invention, there is provided an apparatus for the cryogenic separation of air comprising: a high pressure column for separating cooled feed air into high pressure nitrogen-enriched overhead vapor and crude liquid oxygen; a low pressure column for separating at least one low pressure column feed stream comprising nitrogen and oxygen into low pressure nitrogen-rich overhead vapor and liquid oxygen; conduit means for feeding a liquid stream from or derived from the high pressure column as reflux to the low pressure column; an auxiliary separation column for separating air into auxiliary column nitrogen-rich overhead vapor and oxygen-rich liquid; conduit means for removing the nitrogen rich overhead vapour as a product; conduit means for expanding and feeding oxygen-rich liquid from the auxiliary column to an intermediate location in the low pressure column; and conduit means for feeding a nitrogen rich liquid stream from or derived from the HP column as reflux to the auxiliary column.

the diameters of the upper sections of the low pressure column (30) are not larger than that for any other section of the multiple distillation column system.

the apparatus further comprises an air expansion turbine and conduit means for feeding at least a portion of a discharge stream from said turbine to the auxiliary separation column as the expanded air.

the apparatus further comprises a reboiler/condenser for condensing at least a portion of said high pressure nitrogen-enriched overhead vapor by indirect heat exchange against liquid oxygen in the bottom of the low pressure column; conduit means for feeding high pressure nitrogen-enriched vapor from the top of the high pressure column to the reboiler/condenser; and conduit means for feeding at least a portion of condensed nitrogen as reflux from the reboiler/condenser to the top of the high pressure column.

conduit means for feeding condensed nitrogen from the high pressure column as reflux to the auxiliary separation column.

the apparatus does not comprise a mixing column the auxiliary separation column does not have a reboiler/condenser.

A modified triple column process as illustrated in FIG. 1 is proposed for the large oxygen plant.

The apparatus comprises a high pressure column 100, an intermediate pressure column 101 and a low pressure column 102. An auxiliary column 103 is also used.

The air feed to this process is at about 11 bar which results in more compact and less bulky adsorber vessels. The adsorbers can be used for higher air flow since the air is more dense and high pressure is more favorable for the adsorption of moisture and CO2.

The top vapor flow of the high pressure column is reduced by expanding high pressure feed air into the auxiliary low pressure column which distils the air in to a top nitrogen stream and a bottom liquid rich in oxygen. The auxiliary low pressure column operates at a similar pressure to the low pressure column, it is fed by liquid nitrogen reflux at the top. This pressure may be lower than, higher than or equal to the pressure of the low pressure column. A liquid air stream can be optionally fed to this auxiliary column to improve its distillation performance.

Air 1 at 11 bar is divided into three streams following compression, cooling and purification.

One of the streams is stream 8 which cools in the heat exchanger 90 to form stream 6 which is sent in gaseous form to the high pressure column 100. It is separated in the high pressure column 100 into a nitrogen rich stream at the top and a rich liquid stream 10 rich in oxygen at the bottom. The nitrogen rich stream condenses in a first condenser 91 to yield a first liquid reflux stream. Some nitrogen 42 can be extracted at the top of the high pressure column as a product stream and sent to the heat exchanger 90 to be warmed. A portion 11 of the first reflux stream is sent to the low pressure column 102 as reflux stream 14 and to the auxiliary column 103 as reflux 15. Portion 89 of the reflux stream may serve as a nitrogen liquid product. All or a portion of the bottom rich liquid 10 is sent to the bottom of the intermediate column 101 for further distillation. The intermediate column operates at an intermediate pressure between the high pressure column's pressure and the low pressure column's pressure. The first condenser 91 transfers heat between the top of the high pressure column and the bottom of the intermediate column. The intermediate column separates the rich liquid into a second nitrogen rich gas at the top and a very rich liquid 12 at the bottom. Part of the second nitrogen rich gas condenses in a second condenser 92 to yield a second reflux stream and the rest 40 is removed as a gaseous stream and warmed in heat exchanger 90. The very rich liquid 12 is sent to the low pressure column 102 as feed. A portion of the second reflux stream 16 formed in the condenser 92 may be sent to the low pressure column as reflux. The second condenser 92 transfers heat between the top of the intermediate column 101 and the bottom of the low pressure column 102.

Instead of only expanding the feed air to the low pressure column, a portion 31 of feed air is expanded into an auxiliary column 103 using a turbine 80. The auxiliary column works at a pressure between 1.1 bar absolute and 1.8 bar absolute, which is about the same as the pressure of the low pressure column 102. A portion of liquid reflux 15 produced in either high pressure column or intermediate column is fed to the top of the auxiliary column as reflux. This auxiliary column 103 separates the expanded air 32 into nitrogen rich gas 21 at the top and a second rich liquid 60 rich in oxygen at the bottom. The second rich liquid is then expanded and transferred to the low pressure column 102 as feed. The auxiliary column 103 can be located above the low pressure column 102 such that the second rich liquid 60 can flow into the low pressure column by gravity feed, or a transfer pump can be used. The low pressure column 102 separates its feeds into the oxygen liquid 70 at the bottom and low pressure nitrogen gas 20 at the top. The oxygen liquid is pumped to high pressure and vaporized in the main exchanger 90 to yield the gaseous high pressure oxygen product 72. A portion 2 of feed air is further compressed in a warm booster 84, cooled in the heat exchanger 90, to form stream 3, compressed in a cold compressor 82 to form high pressure stream 4 and is used to condense against vaporizing liquid oxygen product in the main exchanger 90. The fluid 5 coming from the exchanger 90 is liquefied and sent to the high pressure column 100.

Part of the feed air 30 at 11 bars may or may not be expanded as stream 33 in turbine 81 to form stream 34 which is sent to the low pressure column 102.

By feeding a very rich liquid produced in the intermediate column to the low pressure column the distillation performance of the low pressure column is greatly improved such that significant expanded air flow to the second low pressure column, combined with significant nitrogen extracted in the high pressure column and/or the intermediate column, can be performed with good oxygen recovery rate.

In the embodiment described in FIG. 1 the cold compression scheme for O2 vaporization is illustrated: the pressure of the air fraction 2 is boosted by compressor 84 and then cooled in exchanger 90 to yield a cold pressurized air stream 3, which is then cold compressed by compressor 82 to yield stream 4 at even higher pressure. Stream 4 is next cooled in exchanger 90 to yield a liquid stream 5 which is then fed to the column system. A portion 33 of feed air can be optionally expanded into the low pressure column 102 to provide additional refrigeration to the system. A portion of low pressure expanded air at the outlet of the expanders 80 or 81 can be sent to the columns 103 and 102 by way of line 36 to evenly distribute the air flow to the columns as needed.

The vapor flow rate in the auxiliary column 103 is determined such that the diameters of the upper sections of the low pressure column 102 are not larger than that for any other section of the multiple distillation column system. Here the low pressure column 102 has the same diameter throughout as the high pressure column 100.

The enhancement of the distillation performance provided by the triple column arrangement of columns 100, 101 and 102 allows us to achieve a vapor flow rate at the top of the auxiliary separation column 103 greater than about 50 percent of the vapor flow rate at the top of the upper low pressure column sections under normal operation.

The traditional approach for backing up the production facilities consisting of several trains operating in a parallel fashion is to install a full size spare train. This spare train or unit can be put in service in a short time to take over the slack of production caused by the outage of one of the components of the other trains. Since the probability of having two outages occurring at the same time is low, it is of common practice to have only one spare train to assure the reliability of the multiple trains. In some situations, if the start up time of the spare unit must be very short or instantaneous then all equipment including the spare unit must run permanently at a reduced rate; when one unit is shut down then the production rate of the remaining units can be increased very rapidly to maintain the overall production.

Another approach, also called boosting, to address the backup problem is to oversize each train such that its production rate can be increased or boosted in the event of outage of one train to maintain the overall production.

Figure 2:
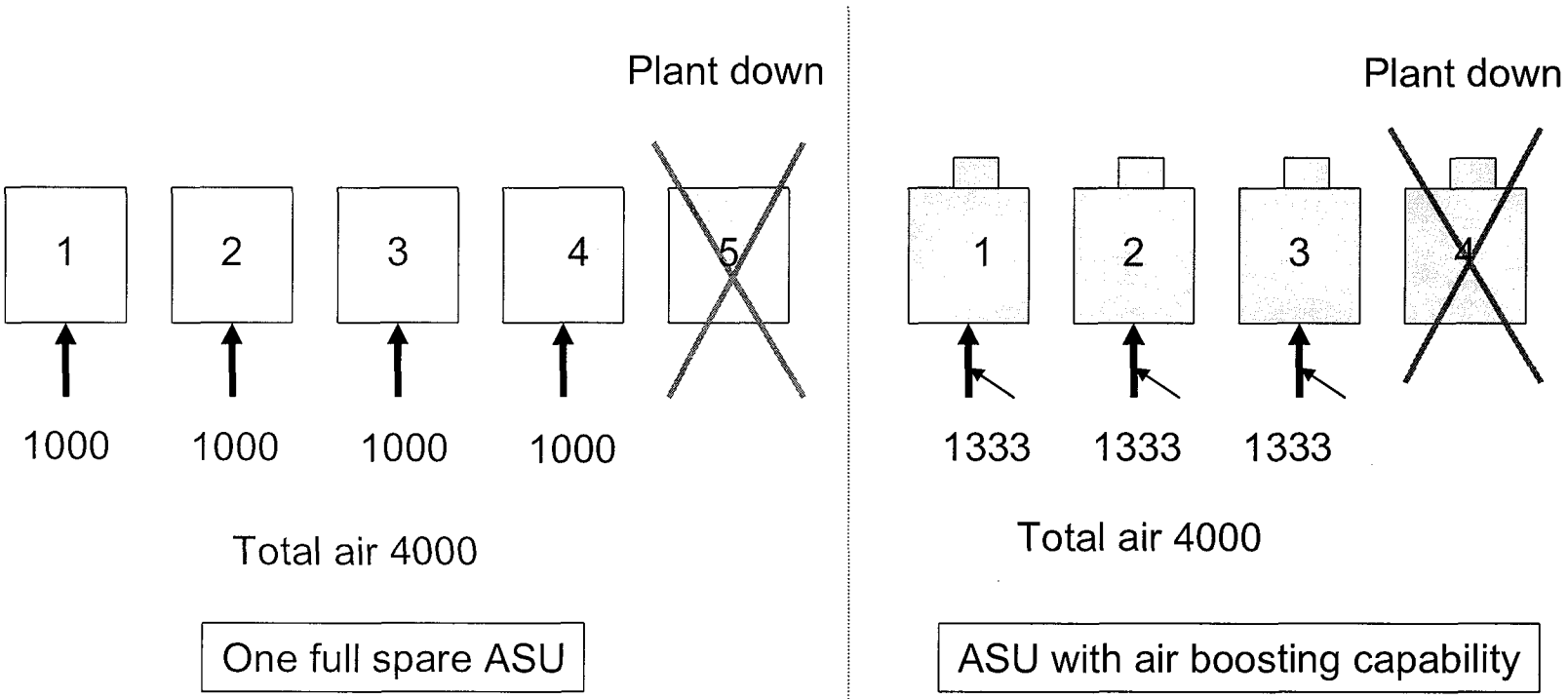
FIG. 2 illustrates boosting, to address the backup problem is to oversize each train such that its production rate can be increased or boosted in the event of outage of one train to maintain the overall production in accordance with one embodiment of the present invention.

The above approaches are illustrated in FIG. 2.

It is clear that the above provisions for backup is costly in terms of capital expenditure since the spare equipment or the extra production abilities are not fully utilized in the majority of the time. Therefore there is a need to improve the cost and effectiveness of the backup equipment, especially in case of large facilities consisting of multiple trains.

The process of FIG. 1 of this invention can also be used to efficiently accommodate higher air throughput for increase of production. Indeed, a major penalty of cryogenic systems subjected to higher air flow above design conditions is the increase of back pressure. At higher air flow, all flows are increased in the process resulting in higher pressure drops in all piping circuits. The increase of back pressure in the low pressure circuit is detrimental to the efficiency of the system since, in case of double column system, for example a 100 mbar increase in back pressure due to higher pressure drop will result in about 300 mbar increase in the pressure of the high pressure column. The air compressor must the overcome this increase in back pressure in addition to the increase of pressure drop at higher flow, and at the same time must deliver higher air flow. The increase of pressure at increasing air flow also requires oversizing the air compressors for higher discharge pressure, which can be detrimental to the efficiency of the compressors and lead to higher power consumption per unit of product. Furthermore, the increase in flow also increases the condenser duty of the main vaporizer transferring heat between the high pressure column and the low pressure column. The increase of duty results in higher temperature difference and therefore even higher operation pressure of the air compressor.

The air in column 100 is separated into a crude oxygen stream 10 and nitrogen rich streams. The crude oxygen stream is sent to the bottom of the low pressure column. The increase of total air flow can be performed via only increasing of flow of stream 31 to expander 80 and column 103. In this case, where under normal flow the column 103 operates at a lower or identical pressure to that of column 102, the column 103 will be operated at a higher pressure to that of column 102. The air flow feeding the other columns 100, 101 and 102 can be kept constant to avoid the increase of back pressure described above. The back pressure will increase in column 103 and at the outlet of expander 80. By confining the increase of back pressure in the dedicated circuit of the expander 80 and the second low pressure column 103, and only on a fraction of the total stream, more flow can be pushed through the system for production increase. And the penalty on the whole system, caused by the increase of flow and the increase of back pressure, can be avoided. There will be higher pressure drop and higher back pressure on the circuit of expander 80 and column 103, but the penalty on power consumption will be minimal and can be easily justified during the backup mode. Except for the dedicated circuit, at higher flow of boosting mode, the main circuits of the process will operate at essentially the same pressure as in normal condition. Therefore the boosting can be achieved without having to oversize the heat exchanger train and the associated piping equipment.

What is claimed is:

1. A process for the cryogenic separation of air using a multiple column distillation system comprising at least a higher pressure column ("HP column") and a lower pressure column ("LP column"), said process comprising the steps of:

feeding cooled feed air to the HP column under conditions effective to separate the cooled feed air into a high pressure nitrogen-enriched overhead vapor and a crude liquid oxygen;

feeding at least one low pressure column feed stream comprising nitrogen and oxygen to the LP column under conditions effective to separate the low pressure column feed stream into an LP nitrogen-rich overhead vapor and an LP liquid oxygen;

refluxing the LP column with a liquid stream from or derived from the HP column;

feeding expanded air to a bottom portion of an auxiliary separation column under conditions effective to separate the expanded air into an AC nitrogen-rich overhead vapor and an AC oxygen-rich liquid and removing the AC nitrogen-rich overhead vapor as a product stream;

feeding a bottom liquid from the auxiliary column to an intermediate location of the LP column;

refluxing the auxiliary column with a nitrogen rich liquid stream from or derived from the HP column;

increasing the amount of the LP liquid oxygen withdrawn from the LP column;

increasing the amount of expanded air sent to the auxiliary column by x %;

increasing the amount of gaseous air sent to the HP column by y %; and increasing the operating pressure of the auxiliary column, wherein y is less than x.

2. The process of claim 1, wherein the vapor flow rate in the auxiliary column is determined such that the diameters of the upper sections of the LP column are not larger than that for any other section of the multiple distillation column system.

3. The process of claim 1, wherein the vapor flow rate in the auxiliary separation column is greater than about 50 percent of the vapor flow rate in the upper LP column sections.

4. The process of claim 1, wherein none of the LP liquid oxygen from the LP column is sent to a mixing column.

5. The process of claim 1, further comprising an intermediate pressure column which receives the crude liquid oxygen from the HP column and, under conditions effective to separate the crude liquid oxygen, produces the at least one low pressure column feed stream comprising nitrogen and oxygen which feeds the LP column.

6. The process of claim 1, wherein the LP liquid oxygen is withdrawn from the LP column and vaporised in a main heat exchanger.

7. The process of claim 1, wherein y is substantially zero.

8. The process according to claim 1, further comprising the steps of expanding air into the LP column; increasing the amount of the LP liquid oxygen withdrawn; and increasing the amount of air expanded to the LP column by z %, wherein z is less than x.

9. The process of claim 1, further comprising the steps of removing the high pressure nitrogen-enriched overhead vapor from the top of the HP column; condensing at least a portion thereof in a reboiler/condenser located in the bottom of the LP column; and feeding at least a portion of the condensed nitrogen as reflux to the HP column.

10. The process of claim 9, wherein the auxiliary column is refluxed with condensed nitrogen produced in the reboiler/condenser.

11. The process of claim 1, wherein the auxiliary separation column comprises an absence of a reboiler/condenser.

12. A process for the cryogenic separation of air using a multiple column distillation system comprising at least a higher pressure column ("HP column"), an intermediate pressure column ("IP column") and a lower pressure column ("LP column"), said process comprising the steps of:

feeding cooled feed air to the HP column under conditions effective to separate the cooled feed air into a high pressure nitrogen-enriched overhead vapor and a crude liquid oxygen;

reducing the pressure and feeding the crude liquid oxygen to the IP column under conditions effective to separate the crude liquid oxygen into a second nitrogen rich gas and a very rich liquid oxygen, wherein the very rich liquid oxygen has a higher concentration of oxygen as compared to the crude liquid oxygen;

reducing the pressure and feeding the very rich liquid oxygen to the LP column under conditions effective to separate nitrogen from the very rich liquid oxygen;

feeding at least one low pressure column feed stream to the LP column under conditions effective to separate the low pressure column feed stream into an LP nitrogen-rich overhead vapor and an LP liquid oxygen, wherein the at least one low pressure column feed stream is selected from the group consisting of expanded air, the very rich liquid oxygen, and combinations thereof;

refluxing the LP column with a liquid stream from or derived from the HP column;

feeding expanded air to a bottom portion of an auxiliary separation column under conditions effective to separate the expanded air into an AC nitrogen-rich overhead vapor and an AC oxygen-rich liquid and removing the AC nitrogen-rich overhead vapor as a product stream;

feeding a bottom liquid from the auxiliary column to an intermediate location of the LP column; and refluxing the auxiliary column with a nitrogen rich liquid stream from or derived from the HP column, wherein the HP column is thermally coupled to the IP column via a first condenser, such that the first condenser provides condensing duties for the HP column and reboiler duties for the IP column, wherein the IP column is thermally coupled to the LP column via a second condenser, such that the second condenser provides condensing duties for the IP column and reboiler duties for the LP column, wherein the auxiliary column and the LP column operate at substantially the same pressure;

further comprising the steps of increasing the amount of the LP liquid oxygen withdrawn from the LP column; increasing the amount of expanded air sent to the auxiliary column by x %; increasing the amount of gaseous air sent to the HP column by y %, and increasing the operating pressure of the auxiliary column, wherein y is less than x.

* * * * *